US008167577B2

(12) United States Patent
Hokkanen

(10) Patent No.: US 8,167,577 B2
(45) Date of Patent: May 1, 2012

(54) FUEL PUMP DEVICE

(75) Inventor: Vesa Hokkanen, Björnlunda (SE)

(73) Assignee: Scania CV AB (Publ) (SE)

( * ) Notice: Subject to any disclaimer, the term of this patent is extended or adjusted under 35 U.S.C. 154(b) by 588 days.

(21) Appl. No.: 12/513,568

(22) PCT Filed: Oct. 29, 2007

(86) PCT No.: PCT/SE2007/050789

§ 371 (c)(1),
(2), (4) Date: May 14, 2009

(87) PCT Pub. No.: WO2008/057032

PCT Pub. Date: May 15, 2008

(65) Prior Publication Data

US 2010/0047084 A1 Feb. 25, 2010

(30) Foreign Application Priority Data

Nov. 10, 2006 (SE) ..... 0602396

(51) Int. Cl.
*F04B 53/08* (2006.01)
*F04B 53/16* (2006.01)

(52) U.S. Cl. ..... 417/32; 417/13; 417/14

(58) Field of Classification Search ..... 417/13, 417/14, 32, 43, 228
See application file for complete search history.

(56) References Cited

U.S. PATENT DOCUMENTS

| | | | | |
|---|---|---|---|---|
| 5,701,873 | A | 12/1997 | Schneider | |
| 6,845,752 | B2 * | 1/2005 | Jay et al. | 123/381 |
| 6,889,665 | B2 * | 5/2005 | Rembold | 123/509 |
| 2004/0052664 | A1 * | 3/2004 | Saito et al. | 417/490 |

FOREIGN PATENT DOCUMENTS

| | | | |
|---|---|---|---|
| EP | 1323919 | A2 * | 7/2003 |
| EP | 1348864 | A1 | 10/2003 |
| EP | 1411240 | A1 | 4/2004 |

OTHER PUBLICATIONS

International Search Report dated Feb. 11, 2008, issued in corresponding international application No. PCT/SE2007/050789.

* cited by examiner

*Primary Examiner* — Joseph L Williams
*Assistant Examiner* — Nathaniel Lee
(74) *Attorney, Agent, or Firm* — Ostrolenk Faber LLP

(57) ABSTRACT

A fuel pump device includes a fuel pump in which pressure-generating components in the form of a movable piston movable through a cylinder in the fuel pump together are operable to pressurize the fuel in a chamber exposed to the components to high pressure. To prevent the clearance between the pressure-generating components from increasing with increased heating of the fuel pump and to maintain a predetermined clearance between the piston and the surrounding cylinder, a temperature-regulator maintains a temperature within a predetermined temperature range in a region of the fuel pump which includes the clearance and at least portions of the pressure-generating components.

10 Claims, 2 Drawing Sheets

FUEL PUMP DEVICE

CROSS REFERENCE TO RELATED APPLICATION

The present application is a 35 U.S.C. §§371 national phase conversion of PCT/SE2007/050789, filed Oct. 29, 2007, which claims priority of Swedish Application No. 0602396-4, filed Nov. 10, 2006, incorporated by reference herein. The PCT International Application was published in the English language.

BACKGROUND TO THE INVENTION, AND STATE OF THE ART

The present invention relates to a fuel pump device with temperature regulation.

One way of reducing discharges of emissions from diesel engines is to inject the fuel at a very high pressure. A so-called "Common Rail" system is commonly used for effecting injection at a high pressure in the combustion spaces of a diesel engine. A Common Rail system comprises a high-pressure pump which pumps fuel at a high pressure to an accumulator tank ("Common Rail"). The fuel in the accumulator tank is intended to be distributed to all the cylinders of the combustion engine. Fuel from the accumulator tank is injected into the combustion spaces of the respective cylinders by electronically controlled injection means.

When a high-pressure pump pressurises the fuel, a certain fuel leakage inevitably occurs at the clearance between the pressure-generating components of the fuel pump, which usually take the form of a piston and a cylinder. The amount of the fuel leakage is related to the efficiency of the fuel pump. A high-pressure pump is normally provided with a piston made at least partly of very wear-resistant material, e.g. ceramic material. Such wear-resistant material usually has a lower thermal expansion coefficient than the metal material normally used in the cylinder. When the high-pressure pump is operating, the energy supplied is partly used for pressurising the fuel, while the remainder converts to heat energy, some of which warms the piston and the cylinder. The fact that the material of the piston has a lower thermal expansion coefficient than the material of the cylinder results in the clearance between the piston and the cylinder increasing as they become warmer. The increasing clearance leads also to the fuel leakage between piston and cylinder increasing with temperature. The fuel leakage itself also gives rise to further heating of the piston and the cylinder when fuel flows at high velocity through the clearance in contact with the surfaces of the piston and the cylinder. This further heating of the piston and the cylinder increases the clearance further, resulting in still greater fuel leakage. During operation of conventional high-pressure pumps there is therefore relatively great heating of the piston and the cylinder, resulting in a large fuel leakage flow and reduced efficiency of the fuel pump. The high fuel pressure may itself also cause expansion of the cylinder with consequently increased clearance between the surfaces of the piston and the cylinder. This expansion of the cylinder is also temperature-dependent.

SUMMARY OF THE INVENTION

The object of the present invention is to present a fuel pump device provided with a fuel pump which can with good efficiency impart a high pressure to the fuel.

The object indicated above is achieved with the fuel pump device of the invention. A fuel pump device includes a fuel pump in which pressure-generating components in the form of a movable piston movable through a cylinder in the fuel pump together are operable to pressurize the fuel in a chamber exposed to the components to high pressure. To prevent the clearance between the pressure-generating components from increasing with increased heating of the fuel pump and to maintain a predetermined clearance between the piston and the surrounding cylinder, a temperature-regulator maintains a temperature within a predetermined temperature range in a region of the fuel pump which includes the clearance and at least portions of the pressure-generating components. Such a temperature-regulating means makes it possible for the pressure-generating components of the fuel pump to maintain a temperature within the predetermined temperature range substantially independently of the load of the fuel pump. Making the temperature range rather narrow makes it possible for the temperature of the components to vary relatively slightly and for their thermal expansion differential to be therefore very small. The difference in thermal expansion between the pressure-generating components thus becomes substantially negligible. The existing clearance between the pressure-generating components can therefore be kept at a substantially constant level when they are at a temperature within the predetermined temperature range. As the clearance remains substantially unchanged during operation of the fuel pump, the pressure-generating components can be dimensioned so that said clearance will be very small within the predetermined temperature range. This makes it possible to maintain an extremely low level of fuel leakage flow. The fuel pump can therefore operate at high efficiency even when very high fuel pressures are generated.

According to an embodiment of the present invention, said temperature-regulating means comprises a medium adapted to flowing through the fuel pump in a passage which extends through said region. Leading a medium at a suitable temperature through the passage results in heat exchange between the medium and the pressure-generating components situated in the region. If the temperature of the components is about to rise to a level above a maximum acceptable value within the temperature range, a flow of medium at a suitable temperature is led through the passage to cool the components. If conversely the temperature of the components in the region is about to drop to a level below a minimum acceptable value within the temperature range, a flow of medium at a suitable temperature is led through the passage to warm the components. Said temperature-regulating means may comprise a valve by which it is possible to control the flow of the medium through said passage. The fact that the flow of medium through the region can be regulated makes it likewise easy to regulate the cooling or warming effect imparted to the pressure-generating components. With advantage, said temperature-regulating means comprises a temperature sensor so positioned that it detects a temperature which is related to the temperature in the region. The current temperature in the region can thus be used as a parameter for regulating the temperature in the region. The fuel pump device preferably comprises a control unit which receives this information and controls the valve so that it supplies the medium in an amount which makes it possible to maintain a temperature in the region within the predetermined temperature range.

According to another embodiment of the present invention, said medium led to the fuel pump is adapted to being at a temperature within said temperature range. An abundant flow of medium through the passage results in a temperature in the region which substantially corresponds to the temperature of the medium. A medium at such a temperature can thus be used both to provide cooling of the pressure-generating components if they are at too high a temperature and to warm them if they are at too low a temperature. Said medium may be coolant which is also used in the cooling system for cooling a combustion engine. Using coolant already existing in a vehicle for cooling the fuel pump means that the temperature-regulating means can be of quite simple design and comprise relatively few components. It is also possible, however, to use other existing liquids in a vehicle for cooling the fuel pump, e.g. diesel oil, petrol etc. It is also possible to use an entirely separate temperature-regulating means which has a circulating medium of its own for regulating the temperature in said region of the fuel pump.

According to another embodiment of the present invention, said temperature-regulating means is adapted to maintaining the temperature in said region within a temperature range in which the difference between the maximum and minimum values of the temperature range is not more than 10° C. In this case, the temperature range is so narrow that the pressure-generating components are subject to very little thermal expansion within the temperature range. Such a temperature range may for example extend from 30° C. to 40° C. The temperature range should have a relatively low minimum temperature, otherwise the clearance between the pressure-generating components becomes so small that it will be difficult to start the fuel pump when there is a cold ambient temperature. Cold starts of the fuel pump can be facilitated by providing an electric heater to preheat the pressure-generating components before the fuel pump starts.

According to another embodiment of the present invention, the pressure-generating components are at least partly made of different materials. The pressure-generating component which comprises the pressure-generating surface is with advantage made of very wear-tolerant material, which may be ceramic material. The other pressure-generating component which defines the space in which the first pressure-generating component is adapted to moving is with advantage made of metal material. Said temperature-regulating means thus keeps the pressure-generating components at a temperature within a relatively narrow temperature range. This makes it possible to use different materials for the respective pressure-generating components, since they are subject to substantially no thermal expansion during operation of the fuel pump.

According to another embodiment of the present invention, the second pressure-generating component is a cylindrical space and the first pressure-generating component is a piston arranged for movement within the cylindrical space. The fuel pump, which comprises pressure-generating components in the form of a piston and a cylinder, can easily effect pressurisation of fuel to a high pressure. Said passage comprises with advantage a space which surrounds the cylindrical space. The temperature-regulating medium can thus flow round the pressure-generating components. The medium can thereby, when necessary, provide very effective cooling or warming of the pressure-generating components.

BRIEF DESCRIPTION OF THE DRAWINGS

A preferred embodiment of the invention is described below by way of example with reference to the attached drawings, in which.

DETAILED DESCRIPTION OF A PREFERRED EMBODIMENT OF THE INVENTION

Figure 1:
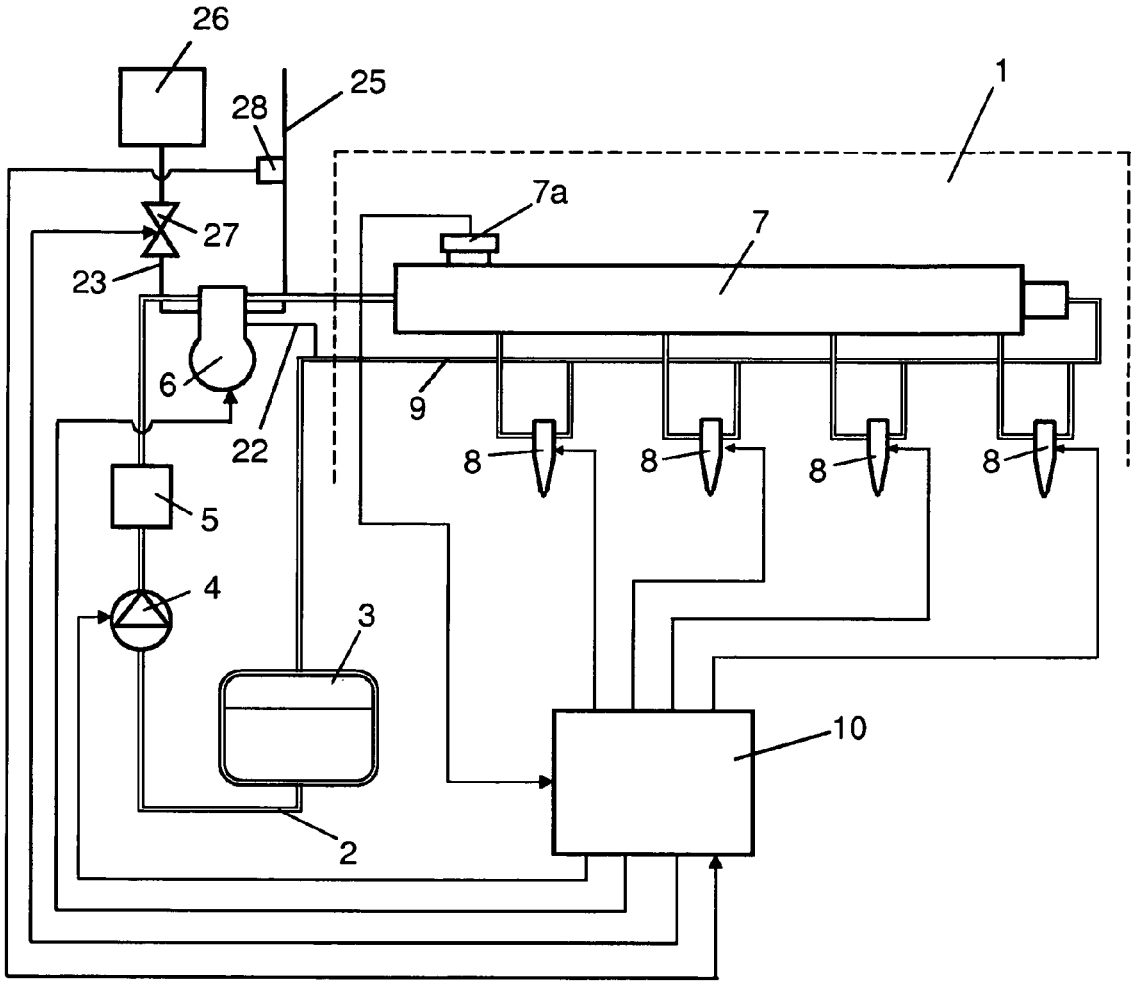
FIG. 1 schematically depicts an injection system with a fuel pump according to the present invention and FIG. 2 schematically depicts a cross-section through the fuel pump in FIG. 1 in more detail.

FIG. 1 depicts an injection system for injecting fuel at a very high pressure in a combustion engine here exemplified as a diesel engine 1. Injecting the fuel at a very high pressure may reduce discharges of emissions from the diesel engine 1. The injection system and the diesel engine 1 may be fitted in a heavy vehicle. The injection system comprises a fuel line 2 for supplying fuel from a fuel tank 3 to the respective cylinders of the diesel engine 1. A first fuel pump 4 is arranged in the fuel line 2 to transfer fuel from the fuel tank 3 to a high-pressure pump 6 via a filter 5. The high-pressure pump 6 is adapted to pressurising the fuel so that it enters at a high pressure an accumulator tank 7 which takes the form of a so-called "Common Rail". Injection means 8 are arranged at each of the connections between the accumulator tank 7 and the respective cylinders of the diesel engine 1. A return line 9 is adapted to leading fuel not burnt in the diesel engine 1 back to the fuel tank 3. In cases where fuel is also used for controlling the opening times of the injection means 8, such a return flow may be abundant. An electrical control unit 10 is intended to control the operation of the fuel pump 4, the high-pressure pump 6 and the injection means 8. The electrical control unit 10 may take the form of a computer unit provided with suitable software for effecting such control. A pressure sensor 7*a* is fitted in the accumulator tank 7 to detect the prevailing pressure therein and send a signal to the control unit 10 conveying information about pressure values detected. On the basis inter alia of that information the control unit 10 can control the injection means 8 so that they inject an optimum amount of fuel at an optimum time into the respective cylinders of the diesel engine 1.

Figure 2:
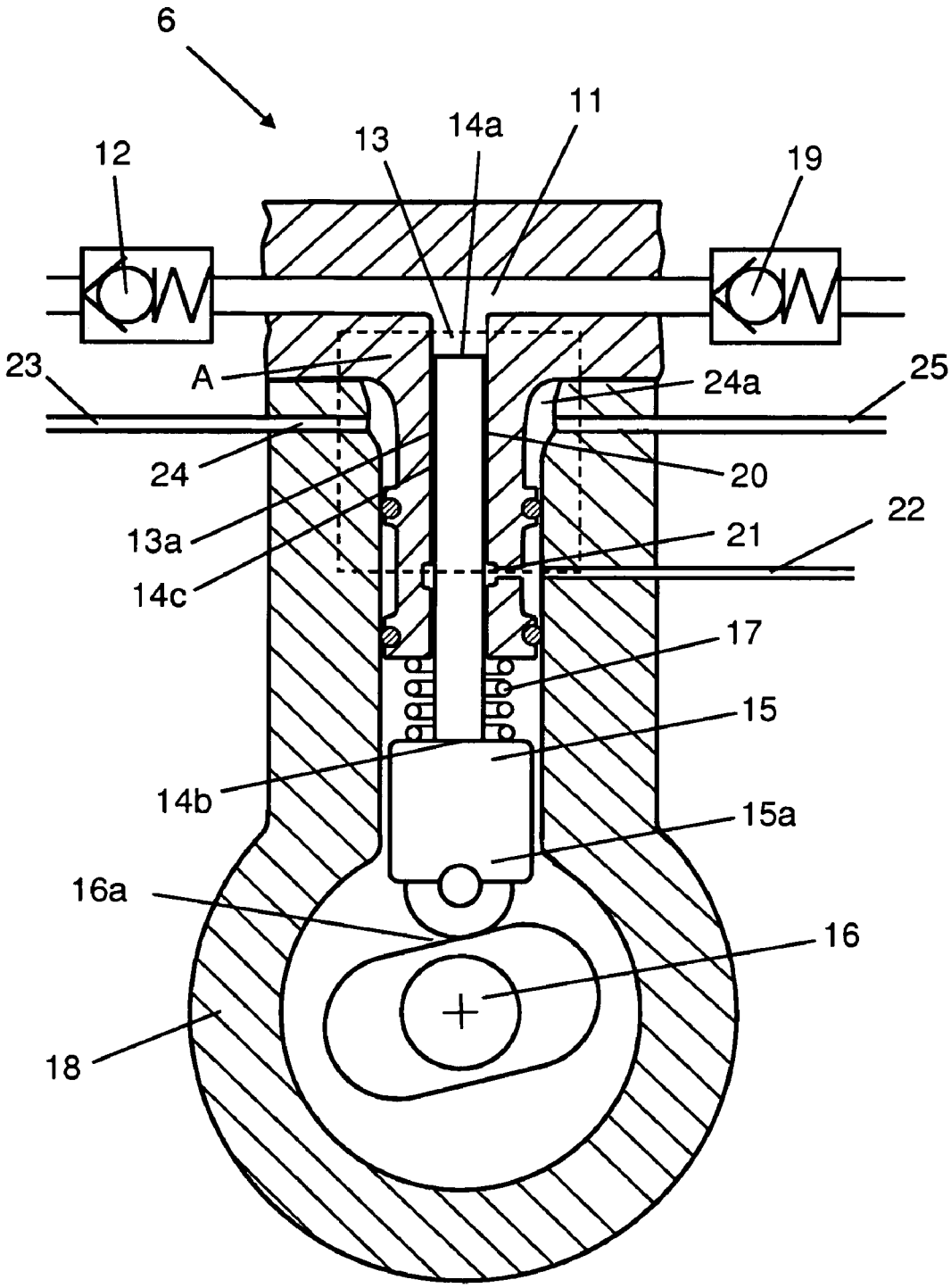

FIG. 2 depicts the high-pressure pump 6 in more detail. The high-pressure pump 6 comprises a chamber 11 for receiving fuel from the fuel line 2. Fuel is adapted to being led to the chamber 11, via a first check valve 12, at a first pressure $P_1$. The high-pressure pump 6 comprises a pressure-generating component constituting a cylindrical space 13 in which a second pressure-generating component in the form of a piston 14 is adapted to moving. The piston 14 comprises a pressure-generating surface 14*a* which constitutes a delineating surface of the chamber 11. The chamber 11 may therefore comprise a variable portion of the space 13 depending on the position of the piston 14 in the cylindrical space 13. The piston 14 has a lower end surface 14*b* in contact with a component 15 which comprises a rolling means 15*a*. The rolling means 15*a* is adapted to rolling along a cam surface 16*a* of a rotatable shaft 16. A spring means 17 is adapted to ensuring that the rolling means 15*a* is kept in continuous contact with the cam surface 16*a*. The high-pressure pump 6 comprises a housing 18 which encloses the aforesaid components.

During operation of the fuel pump, the shaft 16 and the rolling means 15*a* roll along the cam surface 16*a*. The cam surface 16*a* is thus caused to push the component 15 in a vertical direction within a space in the housing 18. The motion of the component 15 converts to a corresponding motion of the piston 14 in the cylindrical space 13. When the piston 14 moves upwards in the cylindrical space 13, the upper end surface 14*a* of the piston imparts a pressure to the fuel which is in the chamber 11. When the pressure reaches a predetermined pressure value $P_2$, a second check valve 19 connected to the chamber 11 opens. The continuing movement of the piston 14 pushes fuel at pressure $P_2$ out, via the second check valve 19, to the accumulator tank 7. When the piston 14 reaches an upper turning position and commences a downward movement in the cylindrical space 13, fuel can again be supplied to the chamber 11, via the first check valve 12, at pressure $P_1$. When the piston 14 during its upward movement pressurises the fuel, there is inevitably a certain fuel leakage in a clearance 20 between an outside wall surface

14*c* of the piston 14 and a wall surface 13*a* which defines the cylindrical space 13. Fuel leaking out through this clearance 20 is captured in a hollow space 21 and led, via a line 22, to the return line 9 and back to the fuel tank 3.

Only part of the kinetic energy supplied by the piston 14 can be used for pressurising the fuel in the chamber 11. A remainder of the energy supplied converts to heat energy, some of which warms the upper end surface 14*a* of the piston 14 and adjacent wall surfaces 13*a* of the cylindrical space 13. The piston 14 is normally made of a more wear-resistant material than the portion which comprises the cylindrical space 13. The piston 14 may for example be made of ceramic material or be provided with a surface layer of ceramic material. The portion which defines the cylindrical space 13 is usually made of metal material which usually has the characteristic of being subject to greater expansion when it becomes heated than the more wear-resistant material of the piston 14. The heating which the piston 14 and the cylinder 13 receive in a conventional fuel pump during operation results in the cylindrical space 13 expanding more than the piston 14, with consequent increase in the clearance 20 between the wall surfaces 14*c*, 13*a* of these components. The greater clearance 20 leads to increased fuel leakage which itself causes further heating of the wall surfaces 13*a*, 14*c* adjacent to the clearance 20 as a progressively larger amount of fuel is pushed through the clearance 20. This further heating of the pressure-generating components 13, 14 adjacent to the clearance 20 results in a further expansion of the cylindrical space 13 relative to the piston 14. When conventional high-pressure pumps are used, the result is relatively greater heating of the piston 14 and the portion which defines the cylindrical space 13. Conventional fuel pumps used for providing high fuel pressure are therefore usually of relatively poor efficiency.

To increase the efficiency of the fuel pump 6, the fuel pump according to the present invention is provided with a temperature-regulating system. The temperature-regulating system is adapted to maintaining a temperature within a predetermined temperature range in a region A of the fuel pump 6 which comprises said clearance 20 and at least adjacent portions of the pressure-generating components 13, 14. Such a predetermined temperature range may be 30° C.-40° C. Such a region A is schematically indicated by broken lines in FIG. 2. The temperature-regulating system comprises a line 23 for supplying a liquid medium to the fuel pump 6. The fuel pump 6 has a passage 24 for receiving and leading the medium through the fuel pump 6. The passage 24 comprises a space 24*a* which surrounds the cylindrical space 13 and the piston 14, making it possible for the medium to flow round the portion of the fuel pump 6 where heat is mainly generated. The passage 24 extends through the region A. When the medium flows through the passage 24, heat exchange takes place between the medium and the pressure-generating components 13, 14 which are mainly situated within the region A. If a sufficient amount of the medium is led through the passage 24, the resulting temperature in the region A substantially corresponds to the temperature of the medium. The medium which has passed through the fuel pump 6 is led away via a line 25.

The medium led to the fuel pump 6 comes in this case from a medium source 26 in which the medium is at a substantially constant temperature. The constant temperature of the medium is within the predetermined temperature range which has to be maintained in the region A of the fuel pump 6. This makes it possible for the medium to absorb heat in the region A when the temperature there is higher than the constant temperature of the medium and to give off heat in the region A when the temperature there is lower than the temperature of the medium. A valve 27 is arranged in the line 23 to control the flow of the medium to the fuel pump 6. The control unit 10 is in this case adapted to controlling the valve 27 on the basis of information from the temperature sensor 28 which detects the temperature of the medium after it has left the fuel pump 6. Knowing inter alia the temperature of the medium after the fuel pump 6 makes it possible for the temperature in the region A to be estimated if the temperature sensor 28 detects a temperature of the medium which indicates that the temperature in the region A is about to rise above the maximum acceptable temperature of the predetermined temperature range, in which case the control unit 10 will regulate the valve 27 so that the flow of medium through the fuel pump 6 increases to intensify the cooling in the region A. In a similar manner, the control unit 10 can intensify the heating in the region A and increase the flow of medium if the temperature sensor 28 indicates that the temperature in the region A is about to drop below a minimum acceptable value. The medium may for example be the coolant used in a cooling system for cooling a combustion engine. The coolant in the cooling system may be available at two temperature levels whereby the lower temperature level may be within the temperature range 30-40° C.

Using such a temperature-regulating system makes it possible for the temperature in the region A which comprises said clearance 20 between the pressure-generating components 13, 14 to be kept within a relatively limited temperature range. It is therefore possible to dimension the cylindrical space 13 and the piston 14 so that they maintain a very small clearance 20 within the predetermined temperature range. The fuel pump will thus provide good efficiency with little leakage via the clearance 20 in substantially all operating states. The presence of the temperature-regulating system also makes it possible to use for the portion which defines the cylindrical space 13, and for the piston 14, materials with relatively different longitudinal expansion characteristics. To provide a very small clearance, the temperature-regulating system may be adapted to maintaining a temperature in the region A within a temperature range in which the difference between the maximum and minimum values of the temperature range is not more than 10°. The fuel pump 6 may be provided with an electric heater or the like which preheats the region A to a minimum acceptable temperature before starting of the fuel pump 6 when there is a cold ambient temperature.

The invention is in no way limited to the embodiment described above but may be varied freely within the scopes of the claims. It is of course possible to use other media than the coolant of the cooling system of a combustion engine, e.g. fuel or some other liquid available in the vehicle may be used. The temperature-regulating system may also be an entirely separate system with a suitable kind of circulating medium of its own.

The invention claimed is:

1. A fuel pump device comprising:

a fuel pump comprising a chamber for receiving fuel, a first pressure-generating component movable in and with respect to the chamber, the first component having a pressure-generating surface which comprises a delineating surface of the chamber such that movement of the pressure generating surface of the first component changes the volume of the chamber, a second pressure-generating component passing around the first component and defining a space in the chamber in which the pressure-generating component is movable, the first and second components being dimensioned to define a clearance between the second pressure-generating component and the first component as the first component moves through the space defined by the second component, a force applying device operable to impart a force to the first component to move the first component reciprocally in the space to pressurize the fuel in the chamber during movement of the first component in a first direction, a temperature-regulator operable to maintain a temperature within a predetermined temperature range in a region of the fuel pump which includes the clearance and includes at least portions of the first and second pressure-generating components which portions of the pressure generating components may be affected by generated heat in the region of the fuel pump.

2. A fuel pump device according to claim 1, wherein the temperature-regulator comprises a passage which extends through the region of the fuel pump and which is operable to flow a medium through the fuel pump region.

3. A fuel pump device according to claim 2, wherein the temperature-regulator comprises a valve operable to control the flow of the medium through the passage.

4. A fuel pump device according to claim 2, wherein the temperature-regulator comprises a temperature sensor operable to detect a temperature in the fuel pump device wherein the detected temperature is related to the temperature in the region of the fuel pump.

5. A fuel pump device according to claim 2, further comprising a medium led to the fuel pump through the passage, wherein the medium is at a temperature within the temperature range.

6. A fuel pump device according to claim 5, wherein the medium is a coolant usable in a cooling system for cooling a combustion engine.

7. A fuel pump device according to claim 1, wherein the temperature-regulator is operable to maintain the temperature in the region within a temperature range in which the difference between the maximum and minimum values of the temperature range is not more than 10°.

8. A fuel pump device according to claim 1, wherein the first and second pressure-generating components are respectively at least partly made of different materials with different coefficients of thermal expansion.

9. A fuel pump device according to claim 1, wherein the second component defines the space as cylindrical, and the first component is a piston operated to move respectively within the cylindrical space.

10. A fuel pump device according to claim 9, wherein the temperature-regulator comprises a passage which extends through the region of the fuel pump and which is operable to flow a medium through the fuel pump region; and the passage comprises a space in the fuel pump device which is located and shaped to surround the cylindrical space and be separated therefrom to avoid medium in the passage communicating into the space.

* * * * *